US007290295B2

(12) United States Patent
Pan

(10) Patent No.: US 7,290,295 B2
(45) Date of Patent: Nov. 6, 2007

(54) CAPTIVE DRAIN PLUG ASSEMBLY

(76) Inventor: Chin-Chi Pan, No. 99, Sec. 3, Chang Tsao Rd., Changhua Hsien, Ho Me Chen (TW)

( * ) Notice: Subject to any disclaimer, the term of this patent is extended or adjusted under 35 U.S.C. 154(b) by 394 days.

(21) Appl. No.: 10/908,290

(22) Filed: May 5, 2005

(65) Prior Publication Data

US 2006/0248637 A1 Nov. 9, 2006

(51) Int. Cl.
*A47K 1/14* (2006.01)

(52) U.S. Cl. ..... 4/295

(58) Field of Classification Search ..... 4/295
See application file for complete search history.

(56) References Cited

U.S. PATENT DOCUMENTS 4,720,877 A * 1/1988 Watts ..... 4/286
5,832,545 A * 11/1998 Pan ..... 4/293
5,881,397 A * 3/1999 Hobbs ..... 4/287
6,418,570 B1 * 7/2002 Ball ..... 4/295

* cited by examiner

*Primary Examiner*—Charles E. Phillips
(74) *Attorney, Agent, or Firm*—Alan Kamrath; Kamrath & Associates P.A.

(57) ABSTRACT

A captive drain plug assembly is securely attached to a drain trap and has a mounting anchor mounted inside the drain trap, a sleeve mounted slidably on the mounting anchor and a decorative stopper attached to the sleeve. When the drain plug is used, the decorative stopper will not detach from the mounting anchor. Further, the decorative stopper can be formed as an interesting figure to increase fun when the decorative stopper is used.

5 Claims, 6 Drawing Sheets

CAPTIVE DRAIN PLUG ASSEMBLY

BACKGROUND OF THE INVENTION

1. Field of Invention

The present invention relates to a drain plug, more particular to a captive drain plug assembly that has an interesting appearance.

2. Description of the Related Art

A conventional drain plug closes a drain of a sink. Many types of drain plugs exist, and some conventional drain plugs have interesting appearances for fun. With reference to FIG. 6, a conventional drain plug (60) selectively closes a drain (70) and comprises a stopper (61) and a decorative knob (62). The stopper (61) is removably mounted in the drain (70) and has a top surface and a mounting recess (611). The mounting recess (611) is defined in the top surface of the stopper (61) and has an annular recess. The decorative knob (62) has a bottom and a connector (621). The connector (621) is formed on and protrudes from the bottom of the decorative knob (62), is mounted in the annular recess (611) and has an annular lip. The annular lip is formed around the connectors, corresponds to and is selectively mounted in the annular recess in the mounting recess (611).

When the conventional drain plug (60) is removed from a drain (70), the decorative knob (62) pulls out of the stopper (61), and the stopper (61) does not come out of the drain (70). Furthermore, the entire plug (60) is easily lost when removed from the drain (70).

The drain plug in accordance with the present invention obviates or mitigates the aforementioned problems.

SUMMARY OF THE INVENTION

The primary objective of the present invention is to provide a drain plug assembly that a stopper that cannot be removed completely from a drain easily and has an aesthetically appealing appearance.

To achieve the objective, a captive drain plug assembly is securely attached to a drain trap and has a mounting anchor, a sleeve and a decorative stopper. The mounting anchor is mounted inside the drain trap. The sleeve mounted slidably on the mounting anchor. The decorative stopper is attached to the sleeve. When the drain plug is used, the decorative stopper will not detach from the mounting anchor. Further, the decorative stopper can be formed as an interesting figure to increase fun when the decorative stopper is used.

Other objectives, advantages and novel features of the invention will become more apparent from the following detailed description when taken in conjunction with the accompanying drawings.

DETAILED DESCRIPTION OF THE INVENTION

Figure 1:
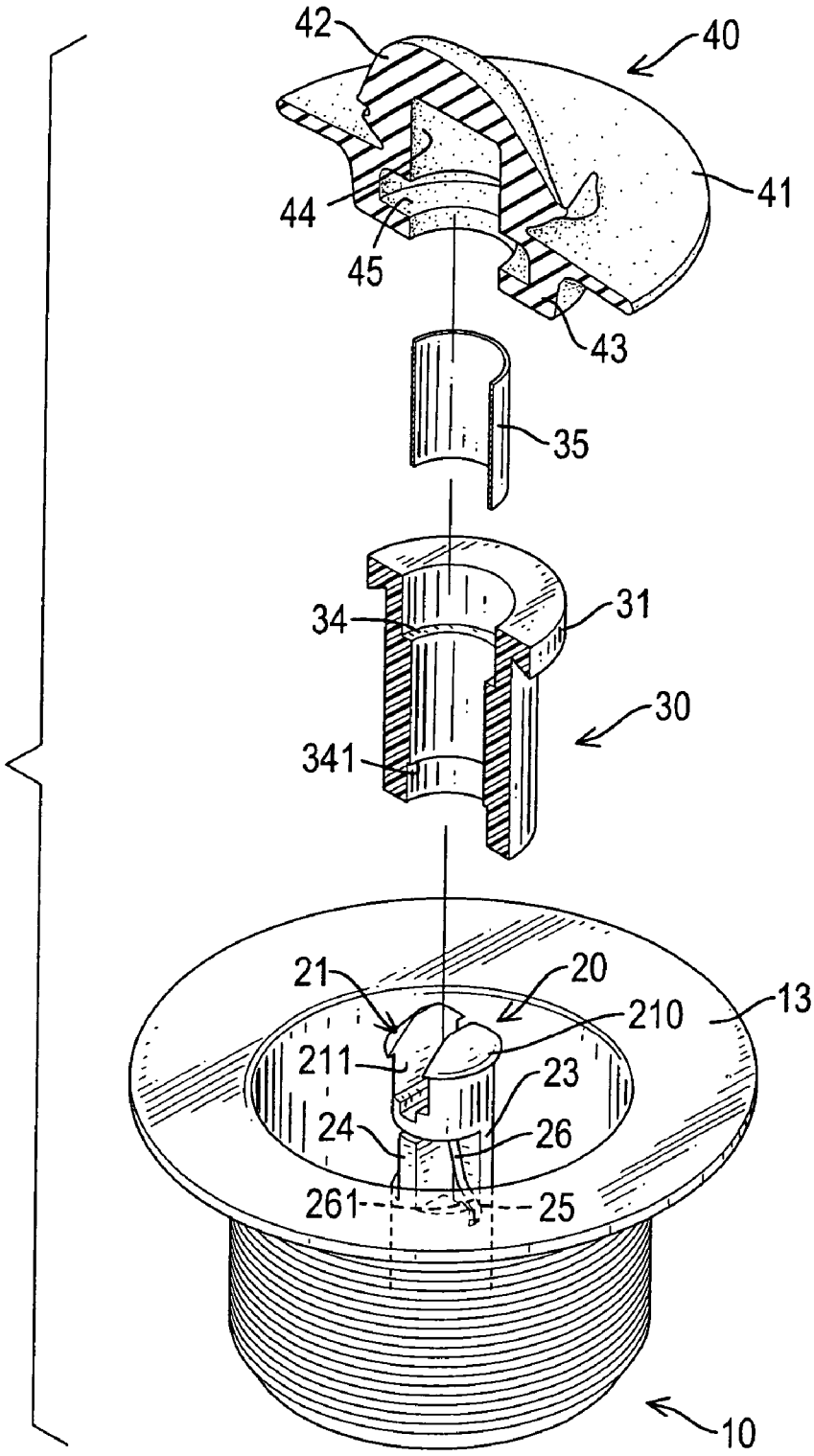
FIG. 1 is an exploded perspective view of a drain plug assembly in accordance with the present invention.
Figure 2:
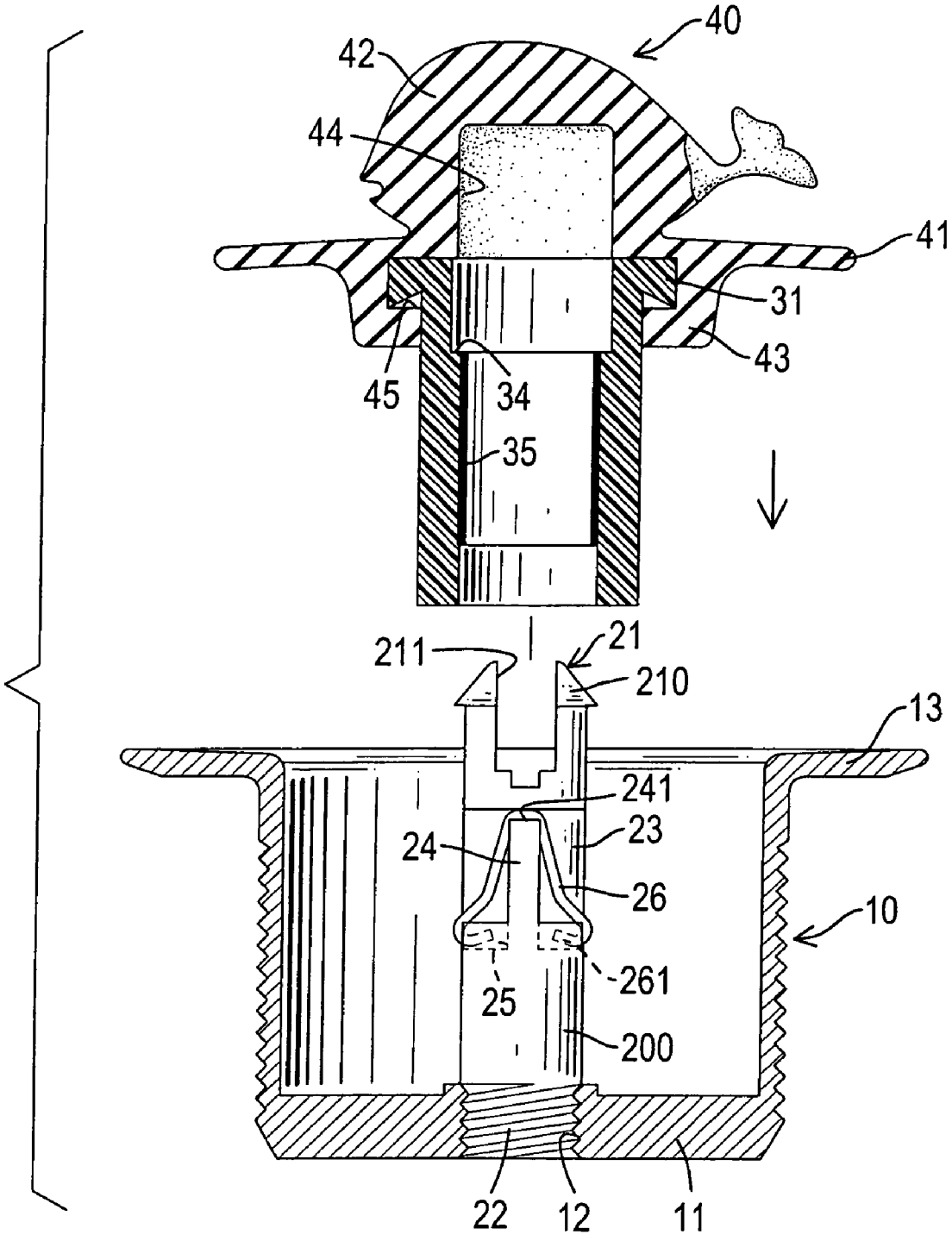
FIG. 2 is a side view in partial section of the drain plug assembly in FIG. 1 when a decorative stopper and a sleeve is attached to a mounting anchor connected to a drain trap.

With reference to FIGS. 1 and 2, a drain plug assembly in accordance with the present invention is mounted in a drain trap (10) and has a mounting anchor (20), a sleeve (30) and a decorative stopper (40).

The drain trap (10) is adapted to be mounted in a drain pipe and has a center, a top edge, a bottom, a cavity, a mounting hole (12) and an annual lip (13). The cavity is formed in the center of the drain trap (10) from the top edge to the bottom and has an open top and a partially open bottom. The mounting hole (12) is defined in the center of the body (10) at the partial open bottom. The annual lip (13) is formed at and extends outwardly from the top edge of the drain trap (10).

The mounting anchor (20) is mounted in the mounting hole (12) in the drain trap (10) and has a post (200) and a head (21).

The post (200) is mounted in the mounting hole (12) and has a top end, a bottom end, a side surface and a limiting device. The bottom end is mounted in the mounting hole (12) in the drain trap (10). In a preferred embodiment, the bottom end is threaded and is screwed into the mounting hole (12) in the drain trap (10). The limiting device is on the side surface of the post (200). In a preferred embodiment, the limiting device has two recesses (23), a bracing piece (24), two optional limit slots (25) and a resilient body (26). The recesses (23) are defined in the side surface, and each recess (23) has a bottom corner. The bracing piece (24) is formed between the recesses (23) and forms a mounting slot (241) that communicates with the recesses (23). The limit slots (25) are defined respectively in the bottom corners of the recesses (23). The resilient body (26) is mounted in the mounting slot (241) and has two optional legs (261). The resilient body (26) is mounted in the mounting slot (241), and the legs (261) are mounted respectively in the limited slots (25).

The head (21) has a top, a conical hook (210) and a slot (211). The conical hook (210) is formed on the top of the head (21), and the slot (211) is defined longitudinally in the head (21).

The sleeve (30) is mounted on the mounting anchor (20) and has a top edge, an inner surface, a lip (31), an inner shoulder (34) and an optional tube (35). The lip (31) is formed on and extends out from the top edge. The inner shoulder (34) is defined in the inner surface, and the tube (35) is mounted inside the inner surface of the sleeve (30).

The decorative stopper (40) is mounted on the sleeve (30) and has a plug (43), a decorative knob (42) and a seal (41). The plug (43) has a top, a bottom, a top edge, an inner surface, a cavity (44) and an annual recess (45). The cavity (44) is defined in the plug (43). The annual recess (45) is defined in the inner surface near the bottom, communicates with the cavity (44) and holds the lip (31) of the sleeve (30). The decorative knob (42) is formed on the top of the plug (43) and may be formed as an interesting character. The seal (41) is formed on the top edge of the plug (43) and extends out radially.

Figure 3:
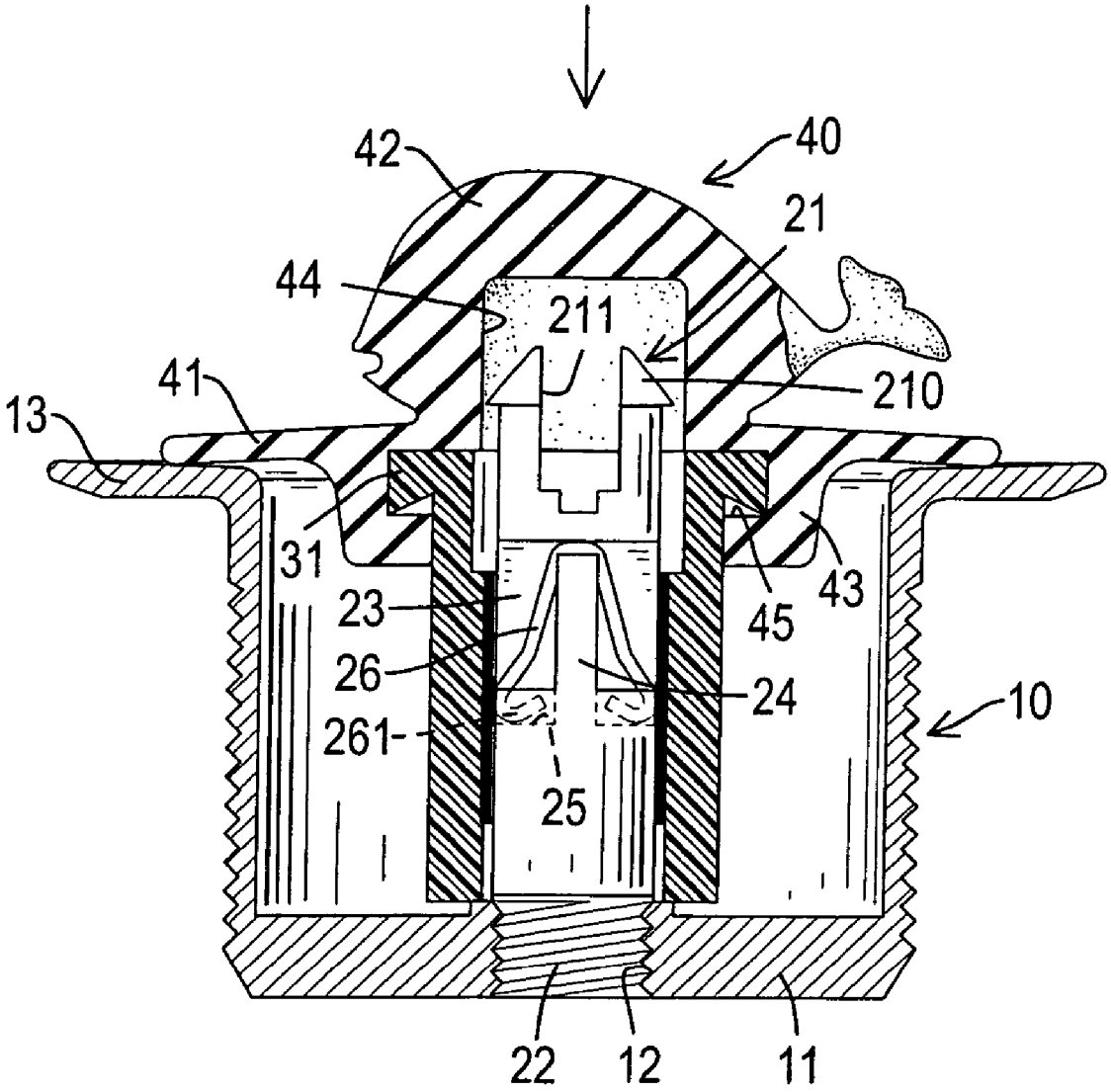
FIG. 3 is a side view in partial section of the drain plug assembly in FIG. 1 when the decorative stopper is pressed down.
Figure 5:
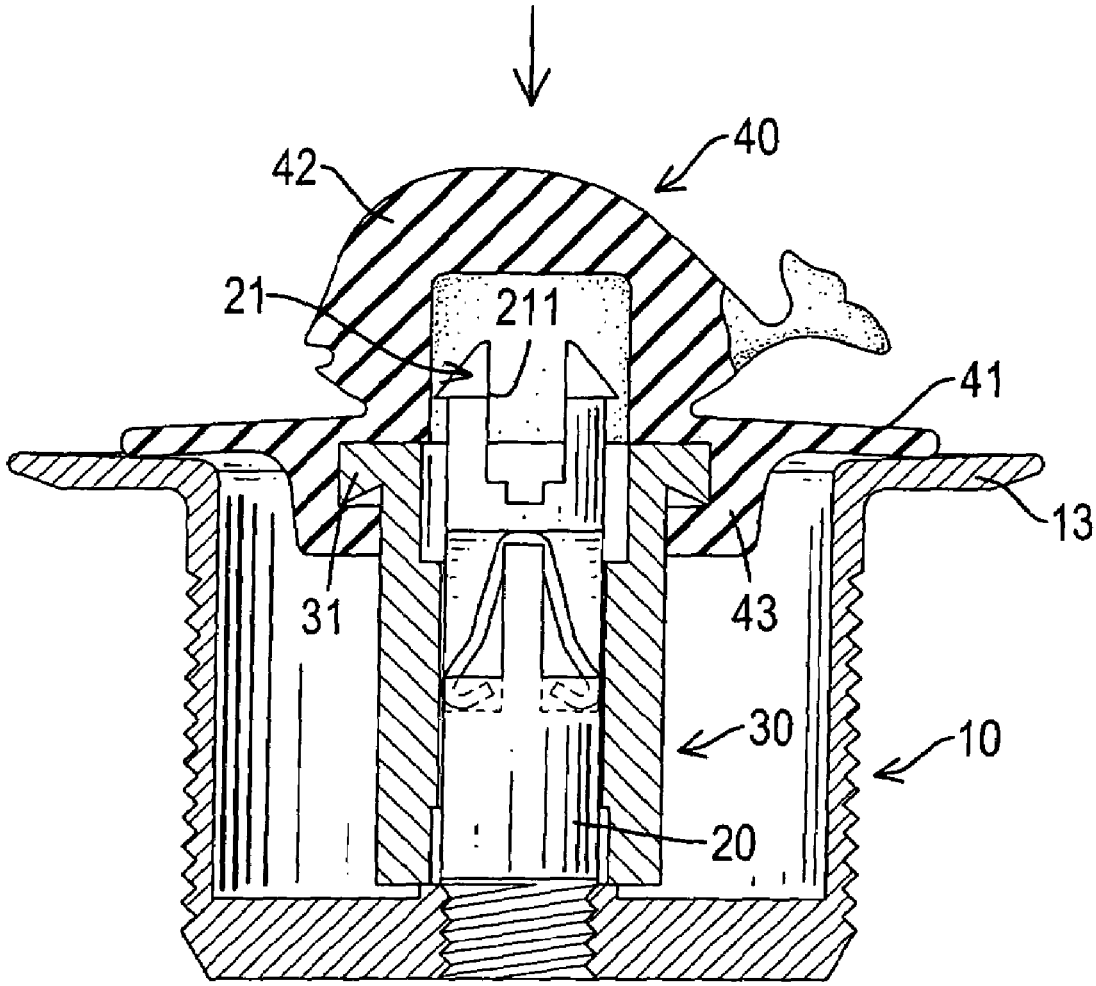
FIG. 5 is a side view in partial section of a second embodiment of the drain plug assembly in accordance with the present invention.
Figure 6:
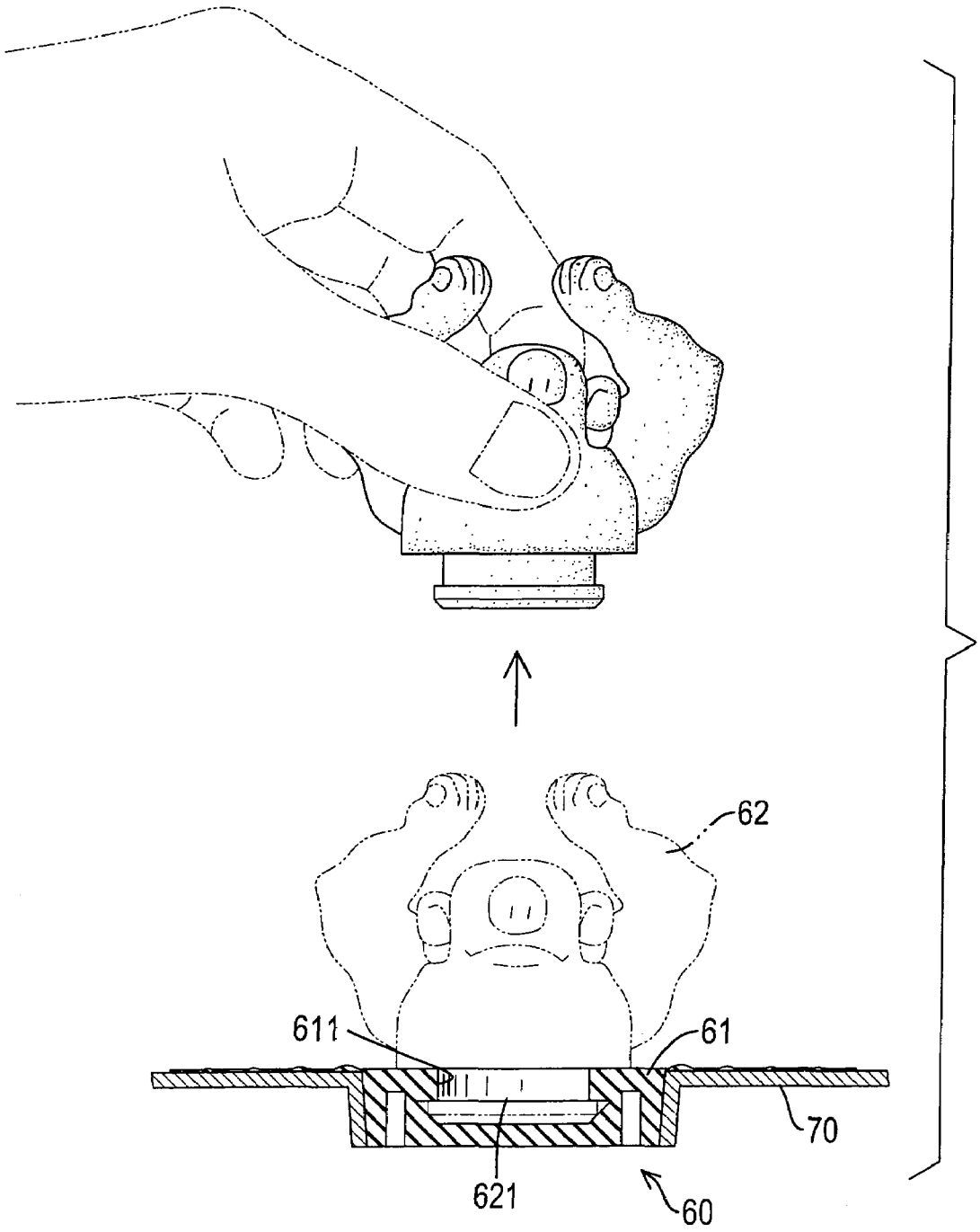
FIG.6 PRIOR ART
FIG. 6 is an operational side view in partial section of a conventional drain plug in accordance with the prior art.

With reference to FIGS. 3 and 5, the decorative stopper (40) is pressed down to seal the drain trap (10), and the head (21) of the mounting anchor (20) moves into the cavity (44) in the decorative stopper (40), and the seal (41) overlaps the annular lip (13) on the drain trap (10) to form a watertight seal. The sleeve (30) is pressed down onto the resilient body (26), and the legs (261) of the resilient body (26) are pressed inside the limit slots (25).

Figure 4:
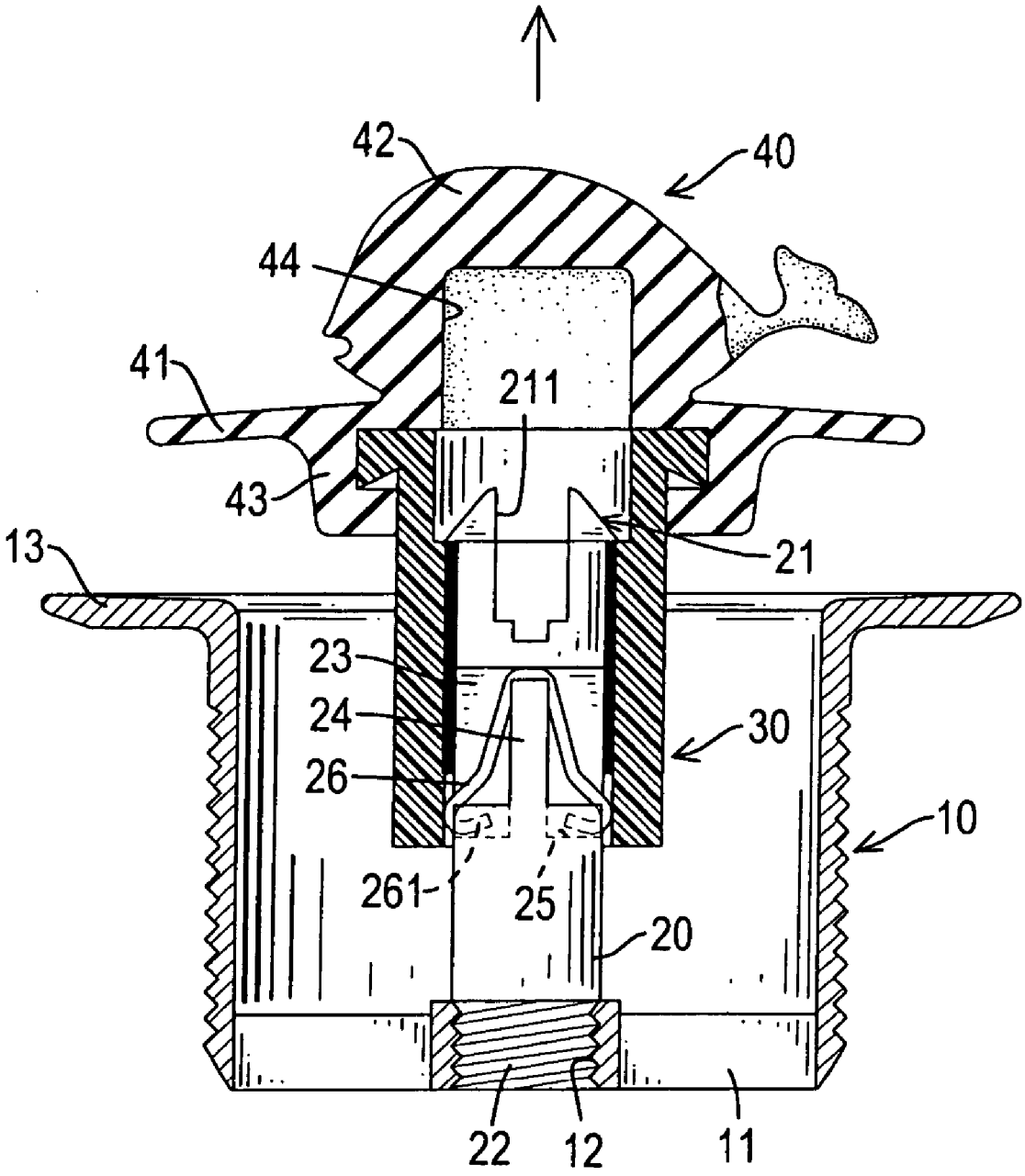
FIG. 4 is a side view in partial section of the drain plug assembly in FIG. 1 when the decorative stopper is pulled up.

With reference to FIG. 4, the decorative stopper (40) is pulled up to open the drain trap (10), and the head (21) on the mounting anchor (20) engages the inner shoulder (34) of the sleeve (30). The legs (261) of the resilient body (26) press against the inner surface of the sleeve (30) to hold the decorative stopper (40) up and prevent the drain trap (10) from being closed again.

The drain plug assembly has the following advantages.

1. The decorative stopper is attached securely to the mounting anchor and does not release from the mounting anchor easily.

2. The decorative knob is formed as an interesting character to increase enjoyment.

The invention may be varied in many ways by a person skilled in the art. Such variations are not to be regarded as a departure from the spirit and scope of the invention, and all such modifications are intended to be included within the scope of the following claims.

What is claimed is:

1. A drain plug assembly comprising
a drain trap having
a center,
a top edge,
a bottom,
a cavity formed in the center from the top edge to the bottom and having an open top and a partially open bottom,
a mounting hole defined in the center at the partially open bottom and,
an annual lip formed at and extending outward from the top edge of the drain trap,
a mounting anchor mounted in the mounting hole in the drain trap and having
a post mounted in the mounting hole and having
a top end,
a bottom end mounted in the mounting hole in the drain trap,
a side surface, and
a limiting device mounted on the side surface of the post, and
a head having
a top, and
a slot defined longitudinally in the head,
a sleeve mounted on the mounting anchor and having
a top edge,
an inner surface,
a lip formed on and extending out from the top edge, and
an inner shoulder defined in the inner surface of the sleeve, and
a decorative stopper mounted on the sleeve and having
a plug having
a top,
a bottom,
a top edge,
an inner surface,
a cavity defined in the plug, and
an annual recess defined in the inner surface near the bottom, communicating with the cavity and holding the lip of the sleeve,
a decorative knob formed on the top of the plug, and
a seal formed on the top edge of the plug and extending out radially.

2. The drain plug assembly as claimed in claim 1, wherein the limiting device of the mounting anchor comprises
two recesses defined in the side surface, and each recess having a bottom corner,
a bracing piece formed between the recesses and forming a mounting slot communicating with the recesses, and
a resilient body mounted in the mounting slot.

3. The drain plug as claimed in claim 2, wherein
the limiting device further two limit slots defined respectively in the bottom corners of the recesses, and
the resilient body has two legs mounted respectively in the limited slots.

4. The drain plug as claimed in claim 3, wherein the sleeve further comprises a tube mounted inside the inner surface of the sleeve.

5. The drain plug as claimed in claim 4, wherein the decorative knob of the decorative stopper is formed as an interesting character.

* * * * *